US006561814B2

(12) United States Patent
Tilbury et al.

(10) Patent No.: US 6,561,814 B2
(45) Date of Patent: May 13, 2003

(54) GARMENT CARRYING ELECTRONIC DEVICES

(75) Inventors: Nancy A. Tilbury, London (GB); Juliette Allen, London (GB); Kyriakos J. Mama, Brighton (GB); Jenni L. Arksey, London (GB); George Marmaropoulos, New York, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/878,993

(22) Filed: Jun. 12, 2001

(65) Prior Publication Data

US 2002/0045363 A1 Apr. 18, 2002

(30) Foreign Application Priority Data

Jun. 12, 2000 (GB) ..... 0014323

(51) Int. Cl.[7] ..... H01R 33/00
(52) U.S. Cl. ..... 439/37; 2/102
(58) Field of Search ..... 439/37; 2/253, 2/247, 79, 2.5, 94, 102, 456, 108, 106, 115, 93–95, 85; 219/211, 527; 224/576, 196, 582, 902, 930

(56) References Cited

U.S. PATENT DOCUMENTS

| | | | | |
|---|---|---|---|---|
| 3,688,315 A | | 9/1972 | Oliver | 2/252 |
| 4,041,549 A | | 8/1977 | Atkinson | 2/94 |
| 4,106,121 A | | 8/1978 | Belson | 2/102 |
| 4,539,700 A | | 9/1985 | Sato | 381/90 |
| 4,876,724 A | | 10/1989 | Suzuki | 381/187 |
| 5,148,002 A | | 9/1992 | Kuo et al. | 219/211 |
| 5,211,321 A | * | 5/1993 | Rodriguez | 224/215 |
| 5,264,830 A | * | 11/1993 | Kline et al. | 340/604 |
| 5,392,973 A | * | 2/1995 | Benson | 224/208 |
| 5,484,366 A | | 1/1996 | Wilkinson | 482/105 |
| 5,509,147 A | * | 4/1996 | Busquets | 2/253 |
| 5,572,401 A | | 11/1996 | Carroll | 361/683 |
| 5,815,843 A | | 10/1998 | Brillhart, III et al. | 2/247 |
| 5,893,991 A | | 4/1999 | Newell | 219/211 |
| 5,946,732 A | | 9/1999 | Richards | 2/247 |

FOREIGN PATENT DOCUMENTS

| | | | |
|---|---|---|---|
| GB | 2305361 A | 4/1997 | A45F/5/00 |
| WO | WO9516948 | 6/1995 | G60F/1/16 |

* cited by examiner

*Primary Examiner*—Renee Luebke
*Assistant Examiner*—Phuongchi Nguyen
(74) *Attorney, Agent, or Firm*—Aaron Waxler

(57) ABSTRACT

A garment is provided comprising a fabric shell (10) hosting one or more electrical conductors (12) the or each of which is connectable to at least one of a plurality of electronic devices (14, 16, 18, 20) housed in respective pockets (P) of the fabric shell (10). The pockets (P) are detachable from the fabric shell (10), with each pocket comprising a fabric cover provided with mechanical connectors, such as patches of Velcro™, zips or press studs. The garment fabric shell (10) is provided with complementary mechanical connectors to enable the fabric cover and device to be removably attached to the garment, each pocket includes an electrical connection between a device in that pocket and one or more of said electrical conductors (12).

11 Claims, 4 Drawing Sheets

GARMENT CARRYING ELECTRONIC DEVICES

FIELD OF THE INVENTION

The present invention relates to portable electronic devices and systems, and in particular to garments comprising a fabric shell provided with means for receiving a plurality of such, suitably interconnected, electronic devices. The invention further relates to covers, for example protective casings, for such devices.

BACKGROUND OF THE INVENTION

An example of a protective casing for an electrical device, in this instance a mobile telephone, is described in United Kingdom patent application GB-A-2 305 361 (Wen-Chung Yu and Edvard Rubin). A particular feature of the casing described, which is only partial to permit user access to the telephone controls, is the provision of internal connectors to the power recharging connections of the mobile telephone and their coupling to an electrical connector mounted externally to the casing: by provision of a recharging station with a corresponding electrical connector, the user is enabled to recharge the mobile telephone without removing it from the jacket.

An example of a garment of the type recited in the opening paragraph is given in U.S. Pat. No. 5,148,002 (Kuo et al) which describes a multi-functional garment comprised of an outer shell garment and a number of electronic modules, including heating, communications and display devices.

A further example of a garment of the type recited in the opening paragraph is given in U.S. Pat. No. 4,539,700 (Sato) which describes a personal portable audio device in the form of a garment having a number of pockets for receiving components of the system, with a pair of speakers for reproduction of the audio being provided in the left and right shoulder portions of the garment: the wiring from the audio signal source component to the speakers is hidden within the garment construction, including connectors within the pockets for establishing electrical connection to a device placed therein.

The Sato patent illustrates one means for responding to a problem of interconnection—namely the wearer of the garment becoming entangled in the wiring interconnecting the various modules or components. Hiding the wiring within the garment itself, and the interconnections to such wiring within the pockets, can lead to further problems. In order to permit repeated cleaning of the garment, whether by dry cleaning or conventional laundry, the electrical devices should be simply removable from the garment. This is in conflict, however, with the need to ensure that the devices are securely held, particularly in the case of garments for sporting activities where there is a risk of the devices falling out of open pockets, but also through a need to maintain contact with the garment-hosted conductors.

SUMMARY CF THE INVENTION

It is accordingly an object of the present invention to provide a garment which addresses the problem of making removal and/or replacement of devices relatively simple.

In accordance with a first aspect of the present invention, there is provided a garment comprising a fabric shell hosting one or more electrical conductors the or each of which is connectable to at least one of a plurality of electronic devices housed in respective pockets of said fabric shell;

wherein said device respective pockets are detachable from said fabric shell, each pocket comprising a fabric cover provided with mechanical connector means, the garment fabric shell being provided with complementary mechanical connector means to enable said fabric cover and device to be removably attached to said garment, each pocket further comprising means to establish electrical connection between a device in that pocket and one or more of said electrical conductors. By making the pockets themselves removable from the garment, rather than requiring the devices to be simply removed therefrom, the present invention provides for the security of attachment of the electronic device to the garment to be determined by the mechanical means holding the pocket in place, rather than by the mechanical security of the in-pocket electrical connection means (as with the above-mentioned Sato system).

The aforesaid means to establish electrical connection may comprise a simple aperture in the pocket fabric cover to permit access to the device electrical connections, although this could leave the device electrical connections exposed and vulnerable. Preferably, however, the means to establish connection comprises an adaptor cable extending from within the pocket to outside, the end of the cable within the pocket having connector means enabling electrical connection to a device within the pocket and the outside end of the adaptor cable being provided with means enabling electrical connection to one or more of said electrical conductors. With such an arrangement, disconnection of the electrical device in the pocket may easily be accomplished without removal of the device from the pocket, as the adaptor cable, pocket, and electrical device could simply be removed as a single unit. To further facilitate this, the means enabling electrical connection between the outside end of the adaptor cable and one or more of said electrical conductors suitably comprises a matched plug and socket pair.

As will be described in fuller detail hereinafter, one or more of the pockets may be attached to the garment, and the fabric shell so configured, that a user is enabled to move the pocket from a first position external to the fabric shell to a second position concealed within an aperture in the shell without disconnection of said complementary mechanical means.

In accordance with a further aspect of the present invention, there is provided a cover for an electrical device having the technical features of a pocket as described above. Unlike the telephone cover of Yu and Rubin mentioned previously, such a cover is suitable for incorporation as a part of a garment, as well as providing means for establishing electrical connection (not just for power recharging) to a covered device. Such a cover may be so shaped as to have a first compartment for receiving an electrical device and one or more further compartments, accessible by a user, for the storage of other items, particularly but not exclusively items associated with the electrical device. For example, such a removable pocket may have a first compartment housing a MiniDisc™ player and a second compartment for holding one or more MiniDiscs to be played.

Further features of the present invention will become apparent from reading of the following description of preferred embodiments, and are defined in the attached claims, to which reference should now be made, and the disclosure of which is incorporated herein by reference.

BRIEF DESCRIPTION OF THE DRAWING

Embodiments of the invention will now be described by way of example with reference to the accompanying drawings in which.

DETAILED DESCRIPTION OF THE PRIMARY EMBODIMENT

Figure 1:
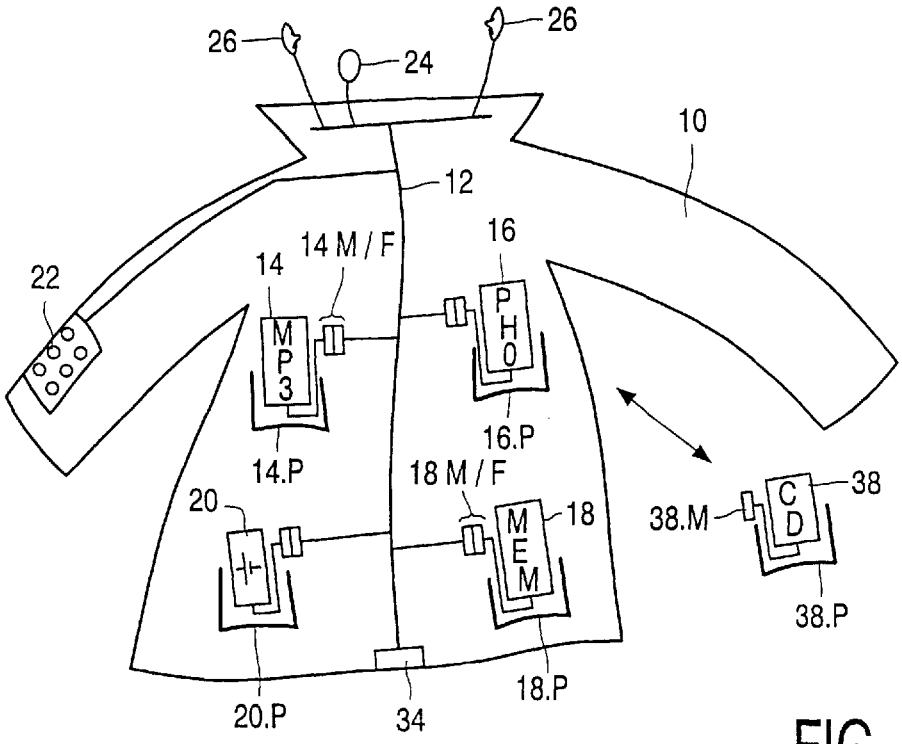
FIGS. 1 and 2 schematically represent garments having associated electrical devices in respective removable pockets.
Figure 2:
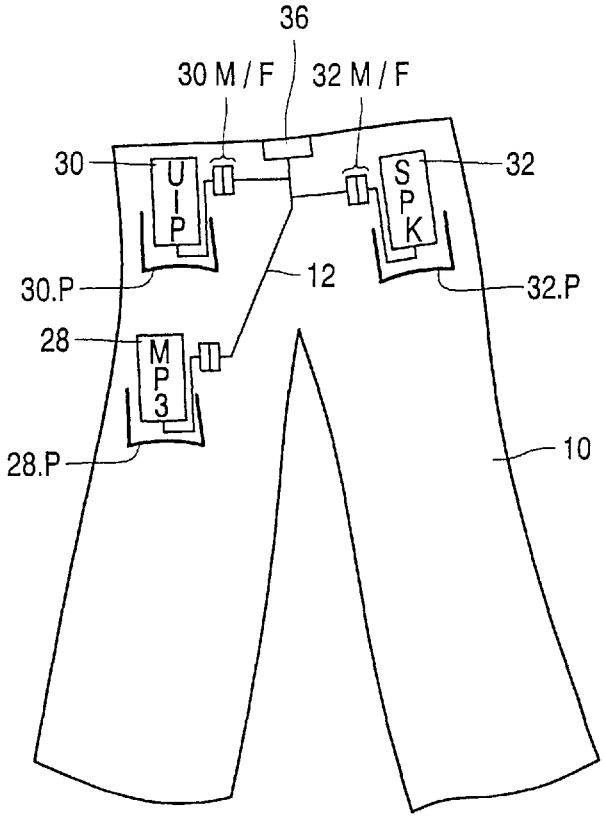

Starting with FIGS. 1 and 2, schematic representations of garments (for upper and lower body respectively) are shown hosting a plurality of interconnected electrical devices. It will be recognised that the form, function and style of the garment will generally have no bearing on the operation of the present invention other than requiring a capability to support two or more electrical devices (which may be in the form of separate components of a single device distributed around the garment).

Each garment comprises a fabric shell 10 hosting one or more electrical conductors, which may range in configuration from a single conductor between a pair of devices to a full wiring loom 12 (as shown) interconnecting a number of devices, to be described: further details of a suitable wiring loom for use with such devices are given in our co-pending concurrently filed application entitled "Garment Component".

In the example of FIG. 1, the devices supported (each in a respective pocket identified by suffix P) comprise a digital audio (MP3) playback device 14, a mobile telephone 16, data storage device 18 holding audio data for the player 14 or numbers for the telephone 16, for example, and a power supply 20 for all devices. Also coupled with the loom 12 may be a set of sleeve mounted controls 22 (for the audio player 14 or telephone 16), as well as a microphone 24 for the telephone 16, and a pair of earphones 26 for use with either the telephone 16 or audio player 14.

In the example of FIG. 2, the devices supported—again in respective pockets P—comprise an audio player 28 (assumed to have an integral power source), control device 30 for the player, and speaker 32 or other audio output arrangement, all interconnected by loom 12. As indicated at 34 in FIG. 1 and 36 in FIG. 2, means may be provided to interconnect the wiring looms (and hence supported devices) in separate garments worn by a user.

Each of the devices in their respective pockets is detachable from the fabric shell 10 and loom 12, as indicated by compact disc (CD) player 38 in respective pocket 38.P shown detached from the loom in FIG. 1. This may be attached in place of the telephone 16 (as indicated). As will be described, each pocket suitably comprises its own adaptor cable terminating in an external male or female connector (suffix M or F) for connection to a corresponding (F or M) connector on the loom 12. As will be recognised, where a single position on the garment can host alternate devices (such as telephone 16 and CD player 38), a common connection should be provided on the loom side of the M/F connector for audio channel and power requirements, such that either device can simply be plugged into the same connector: any adaption in terms of supply voltage or output signal levels should be accommodated within the device itself, or within a dedicated adaptor housed within the pocket.

In an extension or companion feature to the present invention, the whole or a part of the loom 12 might be incorporated within the garment (as in the Sato citation mentioned in the introduction) or, preferably, it may additionally be removable to permit laundry: such a removable wiring or cabling arrangement is described in our co-pending application entitled "Garment with Removable Electronic Devices".

Figure 3:
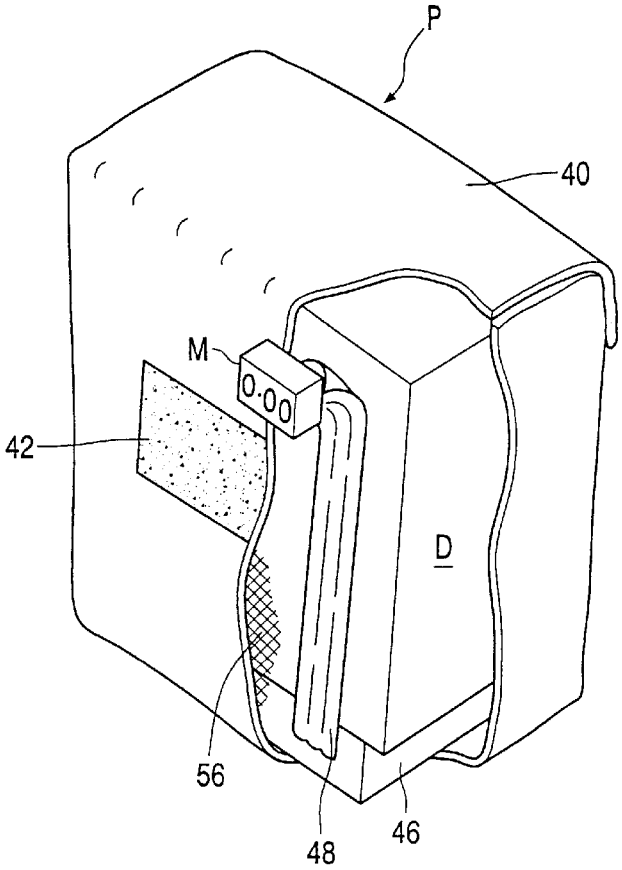
FIG. 3 is a part sectioned perspective view of a pocket containing an electrical device with means for connection to the same.
Figure 4:
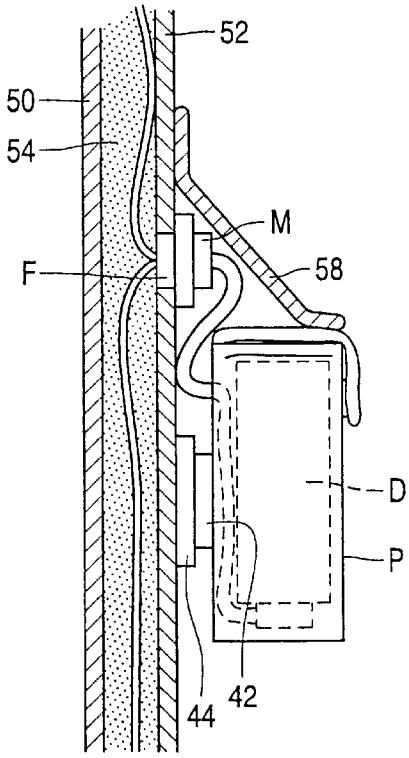
FIG. 4 is a sectioned elevational view of the pocket of FIG. 3 attached to a garment.

As shown in FIG. 3, each pocket P comprises a fabric cover 40 provided with mechanical connector means 42, with the garment fabric shell 10 being provided with complementary mechanical connector means (44; FIG. 4) to enable the fabric cover 40 and device to be removably attached to the garment shell. The mechanical connector means 42, 44 is suitably comprised of patches of Velcro™, although other connector means—including press studs, buttons, zip fasteners, hook and eye connectors and other fasteners—may be used. The pocket fabric cover 40 is preferably openable to permit replacement or access for other reasons to the device with mechanical connector means from the group described, or otherwise, providing securable closure for the pocket.

The pocket P comprises means to establish electrical connection between a device D in that pocket P and the loom 12 (FIG. 1), in the form of a connector 46 at one end of an adaptor cable 48, the connector 46 being configured to plug in or otherwise establish signal and power connections to the device D. As previously described, at the outside end of the adaptor cable (the end outside the pocket) there is provided one half D.M of a male/female (M/F) connector, with the other half being built into the garment local to the pocket to enable connection.

This is shown additionally in FIG. 4 which shows a vertical section through the wall of a garment, illustrated generally as fabric shell 10, comprising an inner lining 50 and outer shell 52 sandwiching a thermally insulating liner material 54, with the garment-mounted (F) half of the connector attached to the outer shell 52 and with the connectors therefrom (i.e. the garment-mounted loom 12) extending within the lining 54. As shown by FIG. 3, the pocket may include conductive mesh or the like 56 to provide electrical shielding for or from the device D, and as shown in FIG. 4, additional fabric flaps or covers may be provided (as at 58) to cover the connector part (M/F) when the pocket is removed.

Figure 5:
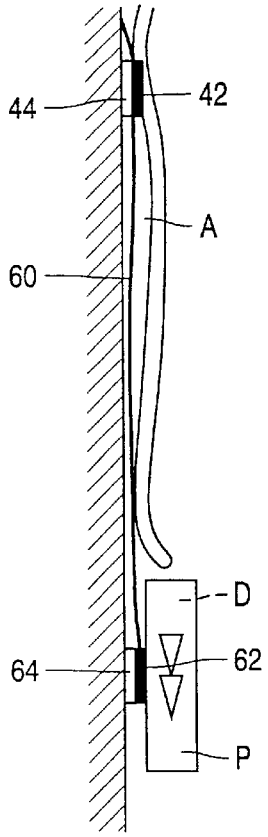
FIGS. 5 to 7 are a sequence of views showing a further embodiment of pocket moving from an open to a closed position.
Figure 6:
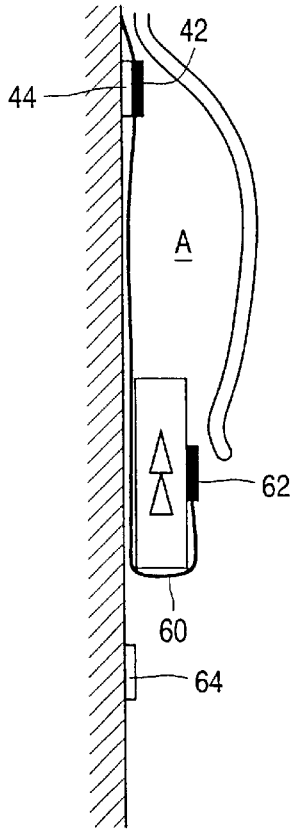
Figure 7:
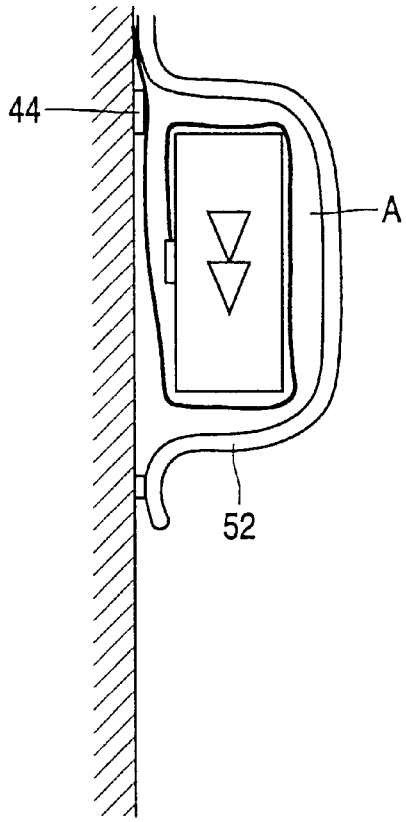

A fold-away embodiment of the device-containing pocket is shown in FIGS. 5 to 7, with FIG. 5 showing the pocket P fully extended, with an elongate side portion 60 suspending the pocket P (with integral device) from mechanical fixing means 42, 44, and with additional such fixing means 62, 64 securing the lower end of the portion 60 against swinging. The adaptor cable for the device D is omitted for reasons of clarity. As shown at 66, the fabric cover of the pocket may be provided with visible markings to identify to a user how the pockets (when removed) should be re-attached to the garment: additionally, the garment itself may be provided with markings (not shown) to indicate how the or each of the pockets should be re-attached.

FIG. 6 shows the embodiment of FIG. 5 in partially stowed mode, with the pocket P partially folded into the elongated side portion 60, heading toward incorporation within a zip-up aperture A inside the outer shell 52 of fabric shell 10.

FIG. 7 shows the pocket P fully incorporated, through folding up of side portion 60, within the aperture A. This arrangement provides security for a user in that, in the opened out arrangement of FIG. 5, the device D is externally mounted and on display to the public (particularly if the pocket P is provided with one or more windows or apertures for the purpose) whereas in the folded away arrangement of FIG. 7, it is hidden from view.

Figure 8:
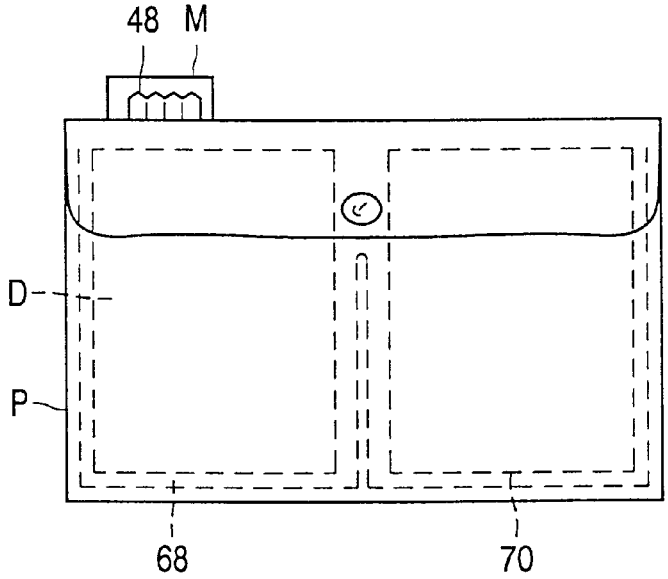
FIG. 8 represents a pocket with capacity for an electrical device and other items.

FIG. 8 shows a further alternative embodiment of pocket P, having a first aperture 68 housing a device D, as before, and a second aperture 70 available to the user for the storage of other items, suitably those associated with the device D, such as audio cassettes for a cassette player.

From reading the present disclosure, other modifications will be apparent to persons skilled in the art. Such modifications may involve other features which are already known in the design, manufacture and use of garments and applications and devices for incorporation therein and which may be used instead of or in addition to features already described herein.

What is claimed is:

1. A garment comprising a fabric shell hosting one or more electrical conductors the or each of which is connectable to at least one of a plurality of electronic devices housed in respective pockets of said fabric shell;

wherein said device respective pockets are detachable from said fabric shell, each pocket comprising a fabric cover provided with mechanical connector means, the garment fabric shell being provided with complementary mechanical connector means to enable said fabric cover and device to be removably attached to said garment, each pocket further comprising means to establish electrical connection between a device in that pocket and one or more of said electrical conductors.

2. A garment as claimed in claim 1, wherein one or more of said pockets includes electrical shielding material.

3. A garment as claimed in claim 1, wherein the complementary mechanical connector means comprise press studs.

4. A garment as claimed in claim 1, wherein the complementary mechanical connector means comprise patches of Velcro™.

5. A garment as claimed in claim 1, wherein the or each of said electrical conductors is removably attached to said fabric shell.

6. A garment as claimed in claim 1, wherein the pocket fabric cover carries external markings indicating to a user how it should be attached to said garment.

7. A garment as claimed in claim 1, wherein the fabric shell carries markings indicating to a user how the or each pocket fabric cover should be attached to said garment.

8. A garment as claimed in claim 1, wherein said means to establish electrical connection comprises an adaptor cable extending from within the pocket to outside, the end of the cable within the pocket having connector means enabling electrical connection to a device within the pocket and the outside end of the adaptor cable being provided with means enabling electrical connection to one or more of said electrical conductors.

9. A garment as claimed in claim 8, wherein the means enabling electrical connection between the outside end of the adaptor cable and one or more of said electrical conductors comprise a matched plug and socket pair.

10. A garment as claimed in claim 1, wherein the pocket fabric cover is openable to permit the removal or replacement of the contained electrical device.

11. A garment as claimed in claim 10, wherein the fabric cover is provided with further complementary mechanical connector means to enable re-closure following removal or replacement of said electrical device.

* * * * *